US009212656B2

(12) United States Patent
Rateick et al.

(10) Patent No.: US 9,212,656 B2
(45) Date of Patent: Dec. 15, 2015

(54) PISTON-TO-SHOE INTERFACE LUBRICATION METHOD

(75) Inventors: Richard Rateick, South Bend, IN (US); William Scott Rowan, South Bend, IN (US); Larry Portolese, Granger, IN (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 1232 days.

(21) Appl. No.: 13/031,445

(22) Filed: Feb. 21, 2011

(65) Prior Publication Data

US 2012/0210867 A1 Aug. 23, 2012

(51) Int. Cl.

| | |
|---|---|
| ***F01B 31/10*** | (2006.01) |
| ***F04B 1/12*** | (2006.01) |
| ***F04B 27/10*** | (2006.01) |
| ***F04B 53/18*** | (2006.01) |

(52) U.S. Cl.

CPC ..... *F04B 1/124* (2013.01); *F04B 27/109* (2013.01); *F04B 53/18* (2013.01)

(58) Field of Classification Search

CPC ..... F04B 1/124; F04B 1/126; F04B 27/109; F04B 53/18

USPC ..... 92/57, 70, 71, 153, 154, 157, 158, 159, 92/160; 417/269; 184/6.16, 6.17; 384/11, 384/12, 108, 109, 213; 74/60; 418/75–77

See application file for complete search history.

(56) References Cited

U.S. PATENT DOCUMENTS

| | | | | |
|---|---|---|---|---|
| 2,155,455 | A * | 4/1939 | Thoma | 91/489 |
| 3,200,760 | A * | 8/1965 | Oswald Thoma et al. | 92/57 |
| 3,216,333 | A * | 11/1965 | Thoma | 92/110 |
| 3,442,561 | A * | 5/1969 | Henry-Biabaud | 384/213 |
| 3,885,457 | A | 5/1975 | Bosch | |
| 3,978,772 | A | 9/1976 | Miyao et al. | |
| 4,478,133 | A | 10/1984 | Eickmann | |

(Continued)

FOREIGN PATENT DOCUMENTS

| | | | |
|---|---|---|---|
| CH | 390649 | A * | 4/1965 |
| DE | 637040 | * | 10/1936 |

(Continued)

OTHER PUBLICATIONS

EP search report, EP 12156275.5-2315 dated May 6, 2012.

(Continued)

*Primary Examiner* — Dwayne J White

*Assistant Examiner* — Logan Kraft

(74) *Attorney, Agent, or Firm* — Ingrassia Fisher & Lorenz, P.C.

(57) ABSTRACT

Methods and apparatus are provided for lubricating a piston-to-shoe interface in a hydraulic motor or pump. Piston assemblies are installed in a housing that are each adapted to receive a reciprocating drive force and are each configured, in response thereto, to cyclically move between an intake direction and a discharge direction. Each piston assembly includes a piston and a piston shoe, and the piston, the piston shoe, or both have a plurality of pockets formed in a surface that defines a piston-to-shoe interface. When the pistons cyclically move, liquid is supplied to each piston-to-shoe interface to form a hydrostatic bearing at each piston-to-shoe interface. A portion of the liquid that is supplied to each piston-to-shoe interface is selectively supplied to and from one or more of the plurality of pockets.

20 Claims, 3 Drawing Sheets

(56) References Cited

U.S. PATENT DOCUMENTS

| | | | | |
|---|---|---|---|---|
| 4,479,420 | A | 10/1984 | Eickmann | |
| 4,635,534 | A * | 1/1987 | Eickmann | 91/488 |
| 4,685,381 | A | 8/1987 | Eickmann | |
| 4,745,846 | A * | 5/1988 | Eickmann | 91/488 |
| 4,776,258 | A | 10/1988 | Eickmann | |
| 4,798,567 | A | 1/1989 | Hoshiro et al. | |
| 4,904,107 | A | 2/1990 | Fukukawa et al. | |
| 5,392,693 | A | 2/1995 | Engel et al. | |
| 5,782,574 | A | 7/1998 | Henkel | |
| 5,795,092 | A | 8/1998 | Jaworski et al. | |
| 5,916,269 | A | 6/1999 | Serbousek et al. | |
| 6,024,011 | A | 2/2000 | Bergmann | |
| 6,231,264 | B1 * | 5/2001 | McLaughlin et al. | 403/76 |
| 6,293,185 | B1 | 9/2001 | Stoppek et al. | |
| 6,406,271 | B1 * | 6/2002 | Valentin | 417/269 |
| 6,488,454 | B1 | 12/2002 | Ahn et al. | |
| 6,702,502 | B1 * | 3/2004 | Graber et al. | 403/34 |
| 6,840,696 | B1 | 1/2005 | Donders | |
| 7,025,182 | B2 | 4/2006 | Rateick, Jr. et al. | |
| 7,040,833 | B2 * | 5/2006 | Kondoh | 403/140 |
| 7,260,878 | B2 * | 8/2007 | Kondoh | 29/441.1 |
| 7,588,384 | B2 | 9/2009 | Yokohara | |
| 7,637,683 | B2 | 12/2009 | Lang et al. | |
| 7,771,485 | B2 | 8/2010 | Grundei | |

FOREIGN PATENT DOCUMENTS

| | | | |
|---|---|---|---|
| DE | 4429053 | C1 | 11/1995 |
| DE | 102007055167 | A1 * | 5/2009 |
| FR | 1426534 | A * | 1/1966 |
| GB | 983310 | | 2/1965 |
| GB | 1317922 | | 5/1973 |

OTHER PUBLICATIONS

EP examination report, EP 12 156 275.5 dated Jun. 19, 2012.

* cited by examiner

PISTON-TO-SHOE INTERFACE LUBRICATION METHOD

TECHNICAL FIELD

The present disclosure generally relates to hydraulic pumps and motors, and more particularly relates to a method for maintaining a hydrostatic bearing at a piston-to-shoe interface in hydraulic pumps and motor.

BACKGROUND

Axial piston pumps and motors are used in myriad systems and environments. Axial piston pumps and motors generally include a housing, a rotor, a port plate, a hanger (or swash plate), and a stack-up assembly. The rotor is rotationally mounted within the housing, and has a number of piston bores formed therein. A piston is movably inserted into each one of the piston bores. The port plate is non-rotationally mounted within the housing adjacent one end of the rotor, and includes a low-pressure side and a high-pressure side. The hanger is also non-rotationally mounted in the housing but may be allowed to pivot about a central axis ninety degrees from the rotor axis. The hanger is disposed at an opposite end of the rotor and at an angle relative to the rotational axis of the rotor. The stack-up assembly is coupled to the angularly disposed hanger and to each of the pistons, and typically includes a cam plate, an auxiliary cam, and an auxiliary cam retainer. During operation, the pistons are cyclically pushed into and/or pulled from the piston bores, depending upon whether the machine is implemented as a pump or a motor.

The pistons in axial piston pumps and motors are typically coupled to piston shoes, which are in turn typically coupled to the stack-up assembly. The piston shoes slidingly engage the cam plate at a piston shoe-to-cam plate interface. The piston shoes may be crimped onto rounded heads of the pistons to form a piston-to-shoe interface. Although the materials that comprise the pistons and piston shoes are selected and processed to achieve wear resistance, lubrication may still be needed. As such, each piston may include an internal channel that extends through it to a feed port at the apex of the rounded head. The primary purpose of this channel is to provide lubrication, via a passageway formed through the piston shoe, to the piston shoe-to-cam plate interface.

Some of the liquid that flows through the internal channel in the piston is also preferably used to lubricate the piston-to-shoe interface. However, test data show that under certain high-load conditions there may be insufficient lubrication at the piston-to-shoe interface. This lack of sufficient lubrication is most evident at the portion of the piston shoe that is furthest from the feed port at the apex of the rounded head. When operating as a pump, the piston-to-shoe interface contact loads are the highest at this portion of the shoe during the intake portion of the operational cycle. At this point in the cycle, the pressure of the liquid being supplied to the feed port is also at a minimum, and may even be less than pump case pressure. Thus, there may be little or no driving force, other than capillary action, to drive lubricant into the piston-to-shoe interface at this point of the cycle, resulting in wear of the piston and/or piston shoe. The resulting wear can lead to increased axial endplay at the piston-to-shoe interface.

Hence, there is a need for a method of providing and maintaining lubrication at a piston-to-shoe interface in axial piston pumps and motors. The present invention addresses at least this need.

BRIEF SUMMARY

In one embodiment, a method for lubricating a piston-to-shoe interface in a hydraulic axial piston machine that comprises a plurality of piston assemblies that are each adapted to receive a reciprocating drive force and are configured, in response thereto, to cyclically move between an intake direction and a discharge direction is provided. Each piston assembly includes a piston and a piston shoe. The piston includes a first end and a substantially rounded second end that has a plurality of pockets formed in at least a portion of an outer surface thereof. The piston shoe includes a cam engagement surface and a skirt portion. The skirt portion has an inner surface that defines a cavity within which the substantially rounded second end is inserted. The skirt portion additionally engages the substantially rounded second end to define a piston-to-shoe interface between the inner surface of the skirt portion and the outer surface of the substantially rounded second end. The method includes supplying the reciprocating drive force to each of the plurality of pistons to cause each piston to cyclically move between the intake direction and the discharge direction, whereby liquid is supplied to each piston-to-shoe interface to form a hydrostatic bearing at each piston-to-shoe interface. While the reciprocating drive force is being supplied to each of the plurality of pistons, a portion of the liquid that is supplied to each piston-to-shoe interface is selectively supplied to one or more of the plurality of pockets, and a portion of the liquid that is supplied to each piston-to-shoe interface is selectively supplied from one or more of the plurality of pockets.

In another embodiment, a method for lubricating a piston-to-shoe interface in a hydraulic axial piston machine that comprises a plurality of piston assemblies that are each adapted to receive a reciprocating drive force and are each configured, in response thereto, to cyclically move between an intake direction and a discharge direction is provided. Each piston assembly includes a piston and a piston shoe. The piston includes a first end and a substantially rounded second end. The piston shoe includes a cam engagement surface and a skirt portion. The skirt portion has an inner surface that defines a cavity within which the substantially rounded second end is inserted, and has a plurality of pockets formed in at least a portion of the inner surface. The skirt portion further engages the substantially rounded second end to define a piston-to-shoe interface between the inner surface of the skirt portion and the substantially rounded second end. The method includes supplying the reciprocating drive force to each of the plurality of pistons to cause each piston to cyclically move between the intake direction and the discharge direction, whereby liquid is supplied to each piston-to-shoe interface to form a hydrostatic bearing at each piston-to-shoe interface. While the reciprocating drive force is being supplied to each of the plurality of pistons, a portion of the liquid that is supplied to each piston-to-shoe interface is selectively supplied to one or more of the plurality of pockets, and a portion of the liquid that is supplied to each piston-to-shoe interface is selectively supplied from one or more of the plurality of pockets.

In another embodiment, a method for lubricating a piston-to-shoe interface in a hydraulic axial piston machine that comprises a plurality of piston assemblies that are each adapted to receive a reciprocating drive force and are each configured, in response thereto, to cyclically move between an intake direction and a discharge direction is provided. Each piston assembly includes a piston and a piston shoe. Each piston includes a first end and a substantially rounded second end that has a plurality of first pockets formed in at least a portion of an outer surface thereof. Each piston shoe includes a cam engagement surface and a skirt portion. The skirt portion has an inner surface that defines a cavity within which the substantially rounded second end is inserted. The skirt portion additionally has a plurality of second pockets formed in at least a portion of the inner surface, and engages the substantially rounded second end to define a piston-to-shoe interface between the inner surface of the skirt portion and the substantially rounded second end. The method includes supplying the reciprocating drive force to each of the plurality of pistons to cause each piston to cyclically move between the intake direction and the discharge direction, whereby liquid is supplied to each piston-to-shoe interface to form a hydrostatic bearing at each piston-to-shoe interface. While supplying the reciprocating drive force to each of the plurality of pistons, a portion of the liquid that is supplied to each piston-to-shoe interface is selectively supplied to one or more of the plurality of first and second pockets, and a portion of the liquid that is supplied to each piston-to-shoe interface is selectively supplied from one or more of the plurality of first and second pockets.

Furthermore, other desirable features and characteristics will become apparent from the subsequent detailed description and the appended claims, taken in conjunction with the accompanying drawings and the preceding background.

BRIEF DESCRIPTION OF THE DRAWINGS

The present embodiments will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
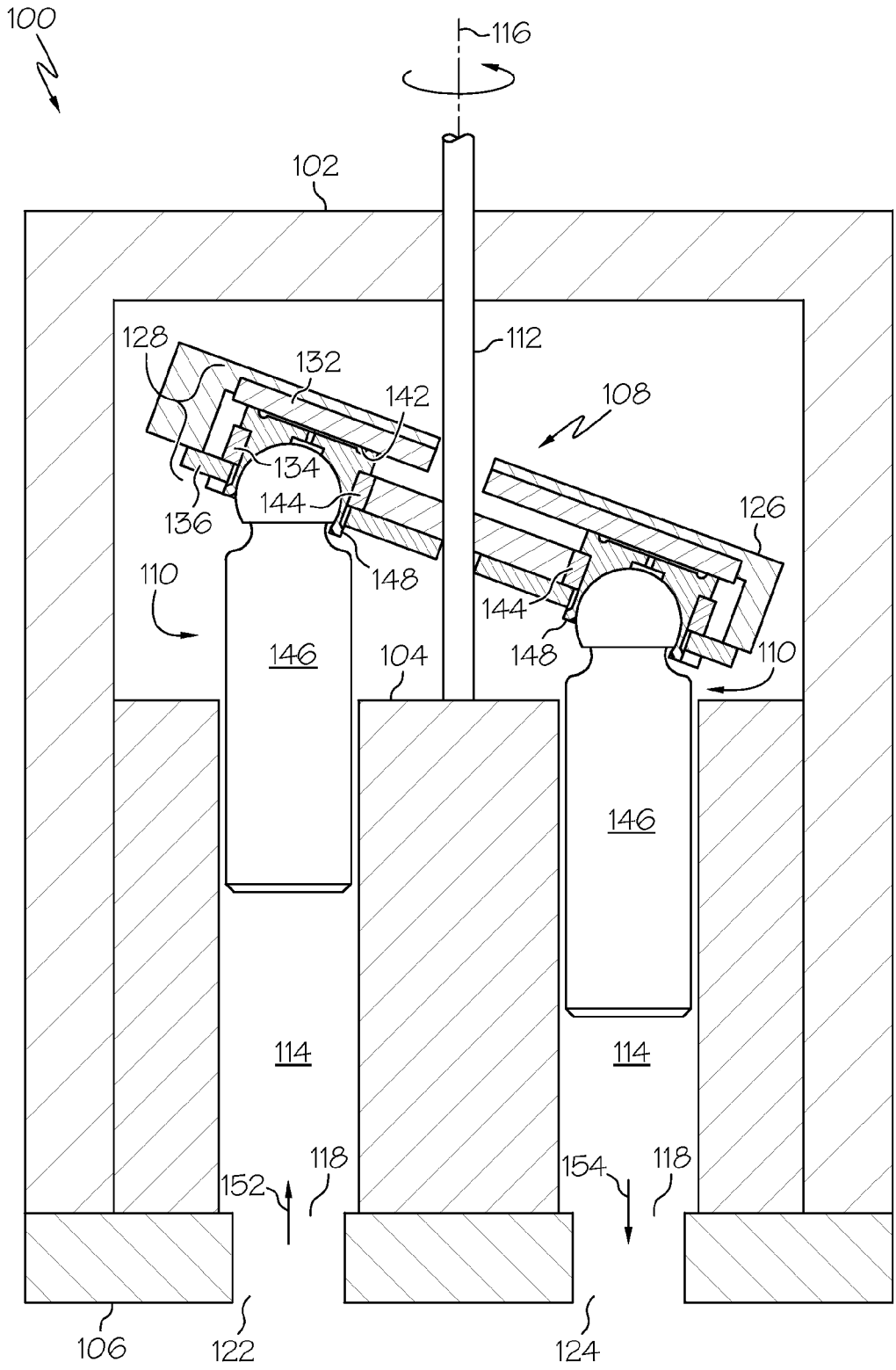
FIG. 1 depicts a simplified cross section view of an axial piston pump.

Referring first to FIG. 1, a simplified cross section view of an embodiment of an axial piston machine 100 is depicted. The machine 100 may be implemented as either a pump or a motor, but in the depicted embodiment it is implemented as a pump, and includes a housing 102, a rotor 104, a port plate 106, a hanger assembly 108, and a plurality of piston assemblies 110 (only two visible).

The rotor 104 is rotationally mounted within the housing 102, and includes a shaft 112 and a plurality of axial piston bores 114. It will be appreciated that the shaft 112 may be formed integrally with the rotor 104, or formed separate from the rotor 104 and subsequently coupled thereto. In either case, the shaft 112 is adapted to receive an input torque from a suitable torque source, such as a motor or engine. The rotor 104 is configured, upon receipt of the input torque to the shaft 112, to rotate about a rotational axis 116. The axial piston bores 114 each include a port 118 through which liquid ingresses and egresses during operation of the machine 100. The liquid that ingresses and egresses the ports 118 does so via the port plate 106, which includes an inlet port 122 and an outlet port 124.

The hanger assembly 108 has an opening through which the shaft 114 extends, and is disposed at an angle relative to the rotational axis 116 of the rotor 104. The hanger assembly 108, at least in the depicted embodiment, includes a hanger 126 and a stack-up assembly 128. The hanger 126 is non-rotationally mounted within the housing 102. As is generally known, the angle at which the hanger 126 is disposed determines the overall stroke of the piston assemblies 110 and thus the flow rate of the pump 100. In at least some embodiments, the hanger angle, and thus the flow rate, may be controllably varied.

The depicted stack-up assembly 128 includes a cam plate 132, an auxiliary cam plate 134, and an auxiliary cam retainer 136. The cam plate 132 is fixedly coupled to the hanger 126 and provides a surface 142 that, as will be described momentarily, a portion of the piston assemblies 110 movably engage. The auxiliary cam plate 134 is mounted on, and rotates with, the shaft 114, and has a plurality of piston openings 144 formed therethrough. A portion of each of the piston assemblies 110 extends partially into one of the piston openings 144 and is retained therein. The auxiliary cam plate 134, and thus each piston assembly 110, is retained via the auxiliary cam retainer 136, which is coupled to the hanger 126 and is thus non-rotationally mounted within the housing 102.

Each of the piston assemblies 110 includes a piston 146 and a piston shoe 148. Each piston 146 is movably disposed in, and extends partially from, one of the axial piston bores 114. Each piston shoe 148 is coupled to, and is also movable relative to, the hanger assembly 108. More specifically, each piston shoe 148 engages the cam plate 132, and extends through a different one of the openings 144 in the auxiliary cam plate 134. Thus, when the shaft 112 receives an input torque, the rotor 104 is rotated. As a result, the stack-up assembly 128 supplies a reciprocating drive force to the piston assemblies 110. The piston assemblies 110, in response to the reciprocating drive force, cyclically move between an intake direction 152 and a discharge direction 154. More specifically, the pump 100 is configured so that the pistons 146 are pulled from the axial piston bores 114 on the low pressure side of the port plate 106, thereby drawing liquid into the axial piston bores 114, and are pushed into the axial piston bores 114 on the high pressure side of the port plate 106, thereby forcing liquid out of the axial piston bores 114.

In addition to the above, the piston assemblies 110 are configured such that, during pump operation, a hydrostatic bearing is formed at the interface of the piston shoe 148 and the cam plate 132. The piston assemblies 110 are additionally configured such that a hydrostatic bearing is formed, and maintained, at the interface of the piston 146 and the shoe 148 (referred to herein as the piston-to-shoe interface). The configuration of the piston assemblies 110 that provides these additional functionalities will now be described.

Figure 2:
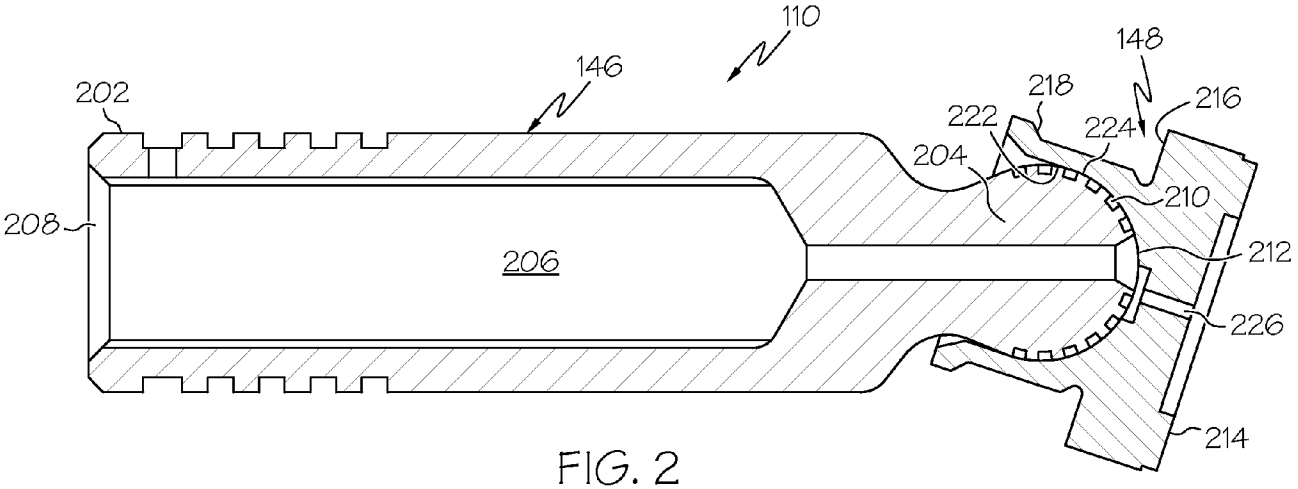
FIG. 2 depicts a cross section view of an embodiment of a piston assembly that may be used to implement the axial piston pump of FIG. 1.

Referring first to FIG. 2, it is seen that each piston 146 includes a first end 202, a second end 204, and an internal channel 206 that extends between the first and second ends 202, 204. The first end 202 is configured to be disposed within the axial piston bores 114 of the rotor 104. The second end 204 is substantially rounded, and in some embodiments may be sufficiently rounded so as to be substantially spherical. The internal channel 206 includes a first port 208, which is disposed in the first end 202, and a second port 212, which is disposed in the second end 204. As will be described further below, the internal channel 206 allows a portion of the liquid that is drawn into the axial piston bores 114 to flow out the second port 212 and supply the liquid to each piston-to-shoe interface.

As FIG. 2 further depicts, a plurality of pockets 210 are formed in at least a portion of the outer surface of the substantially rounded second end 204. The purpose of the pockets 210 is described in more detail further below. It will be appreciated that the size, number, and arrangement of the pockets 210 may be varied. In one particular embodiment, the pockets are arranged in a close-packed matrix pattern, with about 0.1 inches between each pocket 210. Moreover, in this same embodiment the pockets 210 are formed to have a diameter of about 0.047 inches, and a depth of about 0.0006 inches.

The piston shoes 148 each include a cam engagement surface 214, a back flange 216, and a skirt portion 218. When installed in the pump 100, the cam engagement surface 214, as this nomenclature connotes, engages the cam plate 132 (and thus defines a piston-shoe-to-cam plate interface), and the back flange 216 is engaged by the auxiliary cam plate 134. The skirt portion 218 extends from the back flange 216 and has an inner surface 222 that defines a cavity. The substantially rounded second end 204 of the piston 146 is inserted into this cavity, and the skirt portion 218 is crimped onto, or otherwise made to engage, the substantially rounded second end 204. As a result, the above-mentioned piston-to-shoe interface 224 is defined between the inner surface 222 of the skirt portion 218 and the outer surface of the substantially rounded second end 204.

The piston shoe 148 additionally includes a passageway 226 that extends between the inner surface 222 of the skirt portion 218 and the cam engagement surface 214. During pump operation, a portion of the liquid that is drawn into the axial piston bores 114 flows out the second port 212 of each piston 146. A portion of this liquid flows into and through the passageways 226 in each piston shoe 148, and forms the hydrostatic bearing at the interface of each piston shoe 148 and the cam plate 132. A portion of this liquid also flows into, and forms a hydrostatic bearing at, each piston-to-shoe interface 224.

Unlike presently known piston-to-shoe interfaces 224 in axial piston pumps and motors, the piston-to-shoe interface 224 described above evens out the distribution of the liquid supplied to the piston-to-shoe interface 224 throughout operation. More specifically, during operation, as the relative orientations of the pistons 146 and piston shoes 148 vary, a portion of the liquid that is supplied to each piston-to-shoe interface 224 is simultaneously supplied to one or more of the plurality of pockets 210 and from one or more of the plurality of pockets 210. As such, during operation there is a dynamically continuous process of supplying liquid to, and supplying liquid from, the pockets 210, depending on the relative orientation of the pistons 146 and piston shoes 148, and the resultant load at each point of the piston-to-shoe interface 224.

In particular, at various piston/piston shoe orientations, certain portions of the piston-to-shoe interface 224 may be gapped, whereas other portions may be in much closer contact. Liquid may readily flow to those portions of the piston-to-shoe interface 224 that are gapped, whereas those portions in relatively closer contact may be starved of liquid. Thus, liquid will be supplied to the pockets 210 in those portions that are gapped, whereas liquid will be supplied from the pockets 210 in those portions that are in relatively closer contact. As may be appreciated, during operation, those portions of the piston-to-shoe interface 224 that are gapped, and those portions in relatively close contact will vary as the piston assemblies 110 stroke between the intake and discharge directions. Thus, during operation, there is concomitantly a continuous recycling of the pockets 210 that are being supplied with liquid, and the pockets 210 that are supplying liquid.

Figure 3:
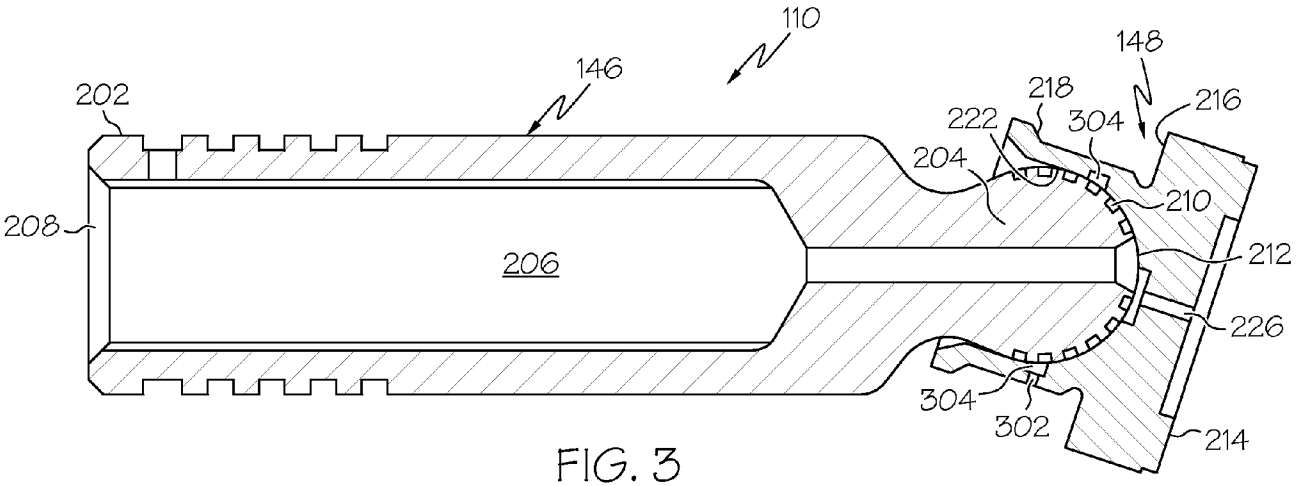
FIGS. 3-5 each depict cross section views of alternate embodiments of the piston assembly depicted in FIG. 2.

In the embodiment depicted in FIG. 2, liquid is supplied to the piston-to-shoe interface 224 via the internal channel 206 in the piston 146. In other embodiments, such as the one depicted in FIG. 3, at least a portion of the liquid may be supplied to the piston-to-shoe interface 224 via a feed port 302 that is formed in and extends through the skirt portion 218 of each piston shoe 148. Although only a single feed port 302 is depicted in FIG. 3, it will be appreciated that plural feed ports could be formed in the piston shoe 148, if needed or desired. As FIG. 3 further depicts, a circumferential groove 304 may also be formed on the inner surface 222 of the skirt portion 218 of each piston shoe 148, and that is in fluid communication with its associated feed port 302.

With embodiment depicted in FIG. 3, when a piston 146 is moving in the discharge direction 154 (see FIG. 1), relatively high-pressure fluid is fed thru the second port 212 in the piston 146, and a portion flows to the piston-to-shoe interface 224, as described above. Though not noted when the embodiment of FIG. 2 was described, a portion of the relatively high-pressure fluid discharged from the second port 212 in the piston 146 flows through the passageway 226 in the piston shoe 148 to form a hydrostatic bearing at the piston shoe-to-cam plate interface.

Conversely, when a piston 146 is moving in the intake direction 152, and is being extracted from its associated axial piston bore 114, fluid velocity effects can cause the liquid pressure in the axial piston bore 114 to drop lower than internal pressure within the housing. This can potentially cause at least portions of the piston-to-piston shoe interface 224 to become starved of liquid. The one or more feed ports 302 and associated circumferential groove(s) 304 provide an additional path for liquid flow to the piston-to-shoe interface 224. Thus, if the pressure at the piston-to-shoe interface 224 drops below case pressure, liquid from case will be drawn into the piston-to-shoe interface 224 and provide an additional source of lubricant.

Figure 4:
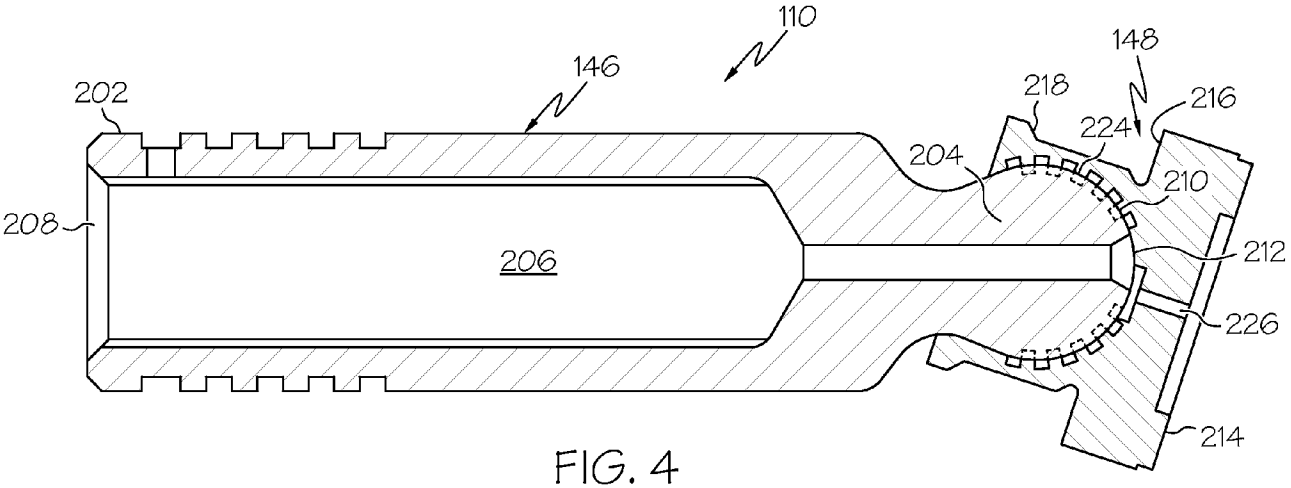
Figure 5:
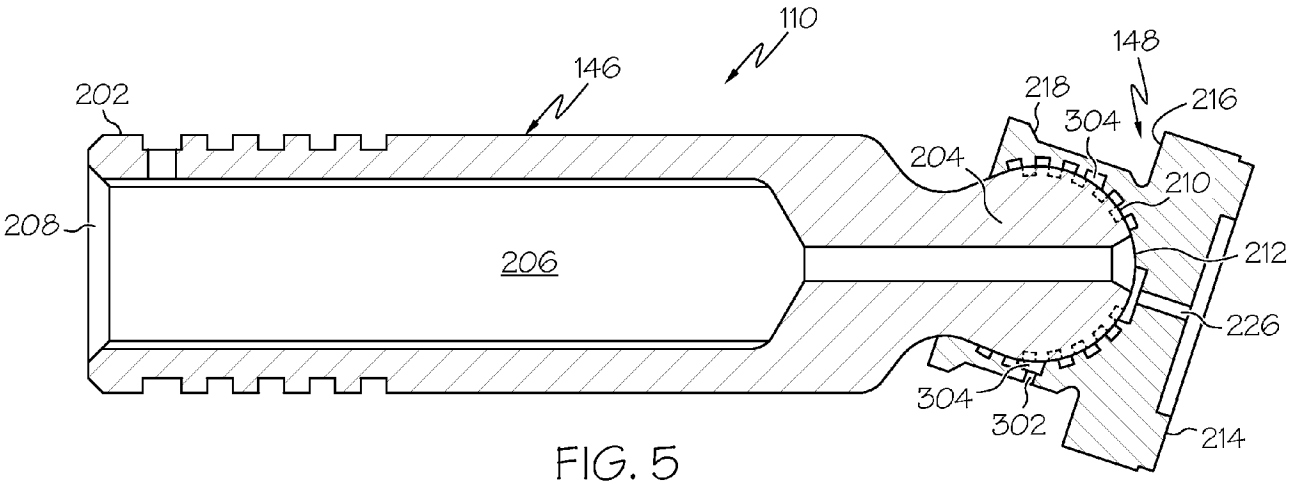

The embodiments depicted in FIGS. 2 and 3 have the plurality of pockets 210 formed in at least a portion of the outer surface of the substantially rounded second end 204 of each piston 146. In other embodiments, such as those depicted in FIGS. 4 and 5, the plurality of pockets 210 may instead (or additionally) be formed on the inner surface 222 of the skirt portion 218 of each piston shoe 148.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for lubricating a piston-to-shoe interface in an axial piston machine that comprises a plurality of piston assemblies that are each adapted to receive a reciprocating drive force and configured, in response thereto, to cyclically move between an intake direction and a discharge direction, wherein each piston assembly comprises (1) a piston that includes a first end and a substantially rounded second end, the substantially rounded second end having a plurality of pockets formed in at least a portion of an outer surface thereof, and (2) an associated piston shoe including a cam engagement surface and a skirt portion, the skirt portion having an inner surface that defines a cavity within which the substantially rounded second end is inserted, the skirt portion engaging the substantially rounded second end to define the piston-to-shoe interface between the inner surface of the skirt portion and the outer surface of the substantially rounded second end, the method comprising the steps of:

supplying the reciprocating drive force to each of the plurality of pistons to cause each piston to cyclically move between the intake direction and the discharge direction, whereby liquid is supplied from a liquid source to each piston-to-shoe interface to form a hydrostatic bearing at each piston-to-shoe interface; and while supplying the reciprocating drive force to each of the plurality of pistons, simultaneously:

selectively supplying a portion of the liquid that is supplied to each piston-to-shoe interface to one or more of the plurality of pockets; and selectively supplying a portion of the liquid that is supplied to each piston-to-shoe interface from one or more of the plurality of pockets, thereby providing a dynamically continuous process of simultaneously supplying liquid to, and supplying liquid from, one or more of the plurality of pockets in dependence on relative orientation of each piston to its associated piston shoe and resultant load at each point of the piston-to-shoe interface, wherein at least some of the pockets are isolated from the liquid source in some of the relative orientations.

2. The method of claim 1, wherein:

each piston comprises a channel that includes a first port through the first end, and a second port through the substantially rounded second end; and the method further comprises supplying the liquid to each piston-to-shoe interface via its associated channel.

3. The method of claim 1, wherein:

the skirt portion of each piston shoe comprises a feed port; and the method further comprises supplying at least a portion the liquid to each piston-to-shoe interface via its associated feed port.

4. The method of claim 3, wherein:

the inner surface of the skirt portion of each piston shoe comprises a circumferential groove, the circumferential groove in fluid communication with its associated feed port.

5. The method of claim 3, further comprising:

supplying liquid to each piston-to-shoe interface via its associated feed port when its associated piston is moving in the intake direction.

6. The method of claim 1, wherein the plurality of pockets are formed in at least a portion of the outer surface of the substantially rounded second end in a close-packed matrix pattern.

7. The method of claim 1, wherein a plurality of second pockets are formed on the inner surface of the skirt portion of each piston shoe.

8. The method of claim 1, further comprising at least selectively supplying liquid to each cam engagement surface.

9. The method of claim 8, wherein:

a passageway is formed in each piston shoe that extends between the inner surface of its skirt portion and its cam engagement surface; and the method further comprises at least selectively supplying the liquid to each cam engagement surface via its passageway.

10. A method for lubricating a piston-to-shoe interface in a hydraulic axial piston machine that comprises a plurality of piston assemblies that are each adapted to receive a reciprocating drive force and are configured, in response thereto, to cyclically move between an intake direction and a discharge direction, wherein each piston assembly comprises (1) a piston that includes a first end and a substantially rounded second end, and (2) an associated piston shoe that includes a cam engagement surface and a skirt portion, the skirt portion having an inner surface that defines a cavity within which the substantially rounded second end is inserted, the skirt portion having a plurality of pockets formed in at least a portion of the inner surface, the skirt portion further engaging the substantially rounded second end to define a piston-to-shoe interface between the inner surface of the skirt portion and the substantially rounded second end, the method comprising the steps of:

supplying the reciprocating drive force to each of the plurality of pistons to cause each piston to cyclically move between the intake direction and the discharge direction, whereby liquid is supplied from a liquid source to each piston-to-shoe interface to form a hydrostatic bearing at each piston-to-shoe interface; and while supplying the reciprocating drive force to each of the plurality of pistons, simultaneously:

selectively supplying a portion of the liquid that is supplied to each piston-to-shoe interface to one or more of the plurality of pockets; and selectively supplying a portion of the liquid that is supplied to each piston-to-shoe interface from one or more of the plurality of pockets, thereby providing a dynamically continuous process of simultaneously supplying liquid to, and supplying liquid from, one or more of the plurality of pockets in dependence on relative orientation of each piston to its associated piston shoe and resultant load at each point of the piston-to-shoe interface, wherein at least some of the pockets are isolated from the liquid source in some of the relative orientations.

11. The method of claim 10, wherein:

the skirt portion of each piston shoe comprises a feed port; and the method further comprises supplying at least a portion the liquid to each piston-to-shoe interface via its associated feed port.

12. The method of claim 11, wherein:

the inner surface of the skirt portion of each piston shoe comprises a circumferential groove, the circumferential groove in fluid communication with its associated feed port.

13. The method of claim 12, further comprising:

supplying liquid to each piston-to-shoe interface via its associated feed port when its associated piston is moving in the intake direction.

14. The method of claim 10, wherein:

each piston comprises a channel, each channel including a first port through the first end of each piston and a second port through the substantially rounded second end of each piston; and the method further comprises supplying the liquid to each piston-to-shoe interface via its associated channel.

15. The method of claim 10, wherein at least a portion of the outer surface of the substantially rounded second end of each piston comprise a plurality of second pockets.

16. The method of claim 10, wherein the plurality of pockets are formed on the inner surface of the skirt portion of each piston shoe in a close-packed matrix pattern.

17. The method of claim 10, further comprising at least selectively supplying liquid to each cam engagement surface.

18. The method of claim 17, wherein:

each piston shoe comprises a passageway in that extends between the inner surface of its skirt portion and its cam engagement surface; and the method further comprises at least selectively supplying the liquid to each cam engagement surface via its passageway.

19. A method for lubricating a piston-to-shoe interface in a hydraulic motor or pump that comprises a plurality of piston assemblies that are each adapted to receive a reciprocating drive force and are configured, in response thereto, to cyclically move between an intake direction and a discharge direction, wherein each piston assembly comprising a piston that includes a first end and a substantially rounded second end, the substantially rounded second end having a plurality of first pockets formed in at least a portion of an outer surface thereof, and a piston shoe that includes a cam engagement surface and a skirt portion, the skirt portion having an inner surface that defines a cavity within which the substantially rounded second end is inserted, the skirt portion having a plurality of second pockets formed in at least a portion of the inner surface, the skirt portion further engaging the substantially rounded second end to define a piston-to-shoe interface between the inner surface of the skirt portion and the substantially rounded second end, the method comprising the steps of:

supplying the reciprocating drive force to each of the plurality of pistons to cause each piston to cyclically move between the intake direction and the discharge direction, whereby liquid is supplied to each piston-to-shoe interface to form a hydrostatic bearing at each piston-to-shoe interface; and while supplying the reciprocating drive force to each of the plurality of pistons, simultaneously:

selectively supplying a portion of the liquid that is supplied to each piston-to-shoe interface to one or more of the plurality of first and second pockets; and selectively supplying a portion of the liquid that is supplied to each piston-to-shoe interface from one or more of the plurality of first and second pockets, thereby providing a dynamically continuous process of simultaneously supplying liquid to, and supplying liquid from, the plurality of first and second pockets.

20. The method of claim 19, wherein:

the skirt portion of each piston shoe comprises a feed port;

the inner surface of the skirt portion of each piston groove comprises a circumferential groove, the circumferential groove in fluid communication with its associated feed port; and the method further comprises supplying at least a portion the liquid to each piston-to-shoe interface via its associated feed port.

* * * * *